United States Patent [19]

Ricketts

[11] 4,103,888

[45] Aug. 1, 1978

[54] GOLF TEE

[76] Inventor: Joseph H. Ricketts, 1 Lindenwood Ter., Ambler, Pa. 19002

[21] Appl. No.: 754,967

[22] Filed: Dec. 28, 1976

[51] Int. Cl.[2] ..... A63B 57/00

[52] U.S. Cl. ..... 273/33

[58] Field of Search ..... 273/33, 55 R, 55 B, 273/184 B; 248/362, 363; 269/21, 22; 51/235; 279/3

[56] References Cited

U.S. PATENT DOCUMENTS

| | | | |
|---|---|---|---|
| 575,214 | 1/1897 | Lock et al. | 279/3 |
| 1,851,028 | 3/1932 | Worrall | 51/235 |
| 3,116,919, | 1/1964 | Alth | 269/21 |
| 3,584,954 | 6/1971 | Nast | 248/363 X |
| 3,797,797 | 3/1974 | Keller | 248/362 |
| 3,800,741 | 4/1974 | Boulton | 279/3 X |
| 4,019,735 | 4/1977 | Thompson | 273/55 B |

*Primary Examiner*—Richard C. Pinkham
*Assistant Examiner*—T. Brown
*Attorney, Agent, or Firm*—Arthur A. Jacobs

[57] ABSTRACT

A golf tee providing adherance of the golf ball to the holding surface of the tee by means of at least a partial vacuum created under the ball, whereby the restrained or, in effect, heavier ball has greater resistance when struck by the golf club and travels a greater distance because of increased elastic reaction of the ball to the club. The tee includes a hollow housing, the housing being provided with an aperture in its upper surface to sealingly support a golf ball. The inner portion of the housing is provided with a piston which creates a vacuum in the housing when moved downward in the housing while the golf ball is positioned over the aperture. A lever arm is pivotally connected to the housing and piston to facilitate movement of the piston upward and downward in the housing.

1 Claim, 5 Drawing Figures

GOLF TEE

This invention relates to golf ball tees, and it particularly relates to tees adapted to improve the distance and direction of a golf ball driven therefrom.

An elastic golf ball's shape is distorted when hit; it travels because of its reaction to the force of impact when it returns to its original shape after the impact. Since a golf ball is relatively light in weight for the amount of force it is subjected to upon impact, an increase of resistance to the force of impact results in an increase of distance of the flight of the ball. This conforms with the law of action and reaction. In addition, the direction of travel of the ball is more effectively controlled when the ball is securely positioned and does not wobble on its tee at the instant of club contact.

Many different types of tees have been suggested or attempted to be utilized to obtain the desirable increase of distance; however, none of these prior devices has proved to be completely satisfactory.

It is, therefore, an object of the present invention to provide a golf tee which is adapted to effectively increase the distance of flight of a golf ball when it is struck by a golf club.

Another object of the present invention is to provide a golf tee of the aforesaid type which is relatively simple in construction, inexpensive to manufacture and simple to use.

Other objects and many of the attendant advantages of the present invention will be readily appreciated as the same becomes better understood by reference to the following description, when read in conjunction with the accompanying drawings wherein.

Figure 1:
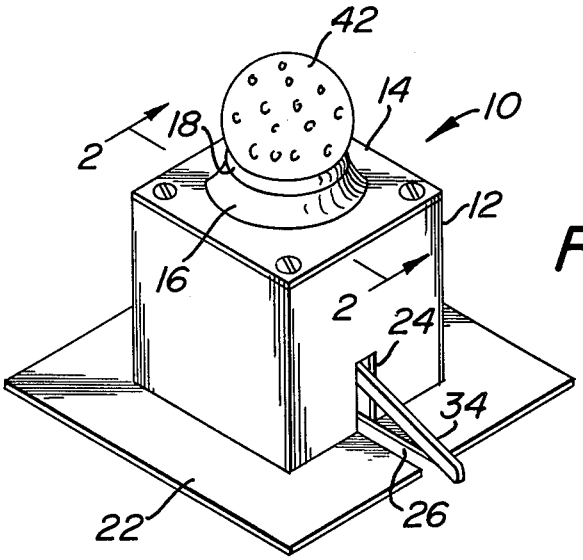
FIG. 1 is a perspective view of a golf tee embodying the present invention.

Referring in greater detail to the figures of the drawing wherein similar reference characters refer to similar parts, there is shown in FIG. 1 a golf tee assembly, generally designated 10, comprising a housing 12, here shown as rectangular but which may, if desired, be made circular, having a removable top lid 14 to the underside of which is secured a flexible sleeve 16 having an upper lip 18 surrounding a central aperture 20.

The housing 12 is mounted on a support pad 22 and is provided with opposed slots 24 adjacent the support pad and mating with a slot 26 in the pad. Actually the pad comprises two separate portions, each connected to the bottom of the housing 12 and spaced from each other to form the slot 26.

The pad 24 is provided with a pair of spaced, parallel standards or ears 28 between which extends a shaft 30 which rotatably supports a disc 32. Integral with the disc 32 is a lever arm 34. The disc 32 is pivotally connected at 36 to a rod 38 which is connected to a piston 40 constructed of either a flexible material, as shown, or a rigid material with a flexible ring at the periphery. The piston 40 is in sealingly slidable contact with the inner surfaces of the housing 12, being actuated up and down by pivotal movement of the arm 34 from the position shown in FIG. 2 to the position shown in FIG. 3.

Figure 2:
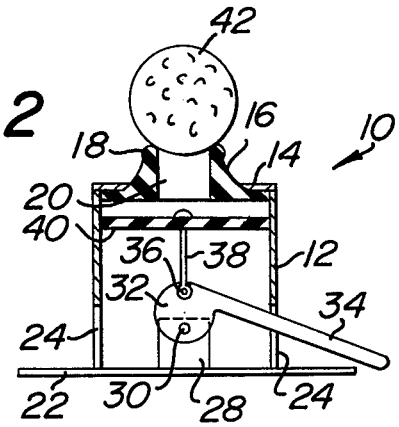
FIG. 2 is a sectional view taken on line 2—2 of FIG. 1.
Figure 3:
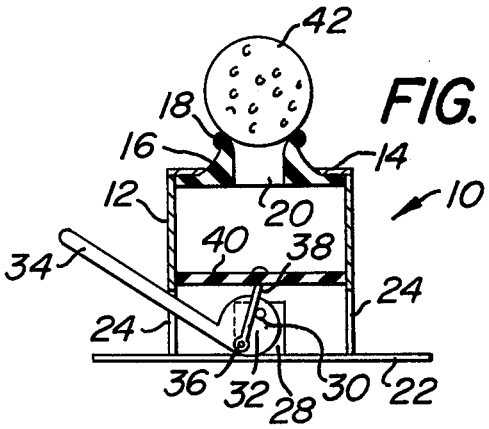
FIG. 3 is a sectional view similar to FIG. 2 but with the piston in retracted position.

In operation of the tee assembly 10 is picked up and a golf ball 42 is placed on the lip 18 of the sleeve 16 while the piston 40 is in the position shown in FIG. 2, the ball forming an air-tight seal with the lip 18. The arm 34 is then moved to the position shown in FIG. 3. During such movement, the piston 40 is moved down and a partial vacuum is formed in the chamber between the top of the piston and the ball. This partial vacuum is sufficient to hold the ball firmly in place but not sufficient to prevent its flight from the tee after being struck by the golf club. The tee assembly, with the ball 42 in place, is then placed on the ground ready for use.

When the golf club strikes the ball, the partial vacuum not only prevents the ball from wobbling at or just prior to contact by the club but places a restraint on the ball which, in effect, increases its weight and, therefore, its resistance to the force of impact. As a result, in accordance with the law of action and reaction, the distance of flight of the ball is significantly increased over what it would otherwise have been.

Figure 4:
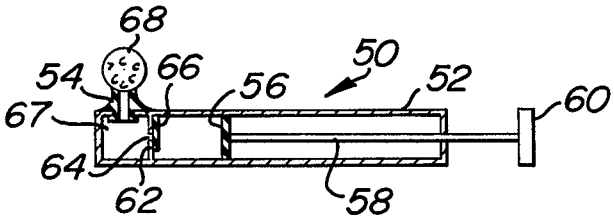
FIG. 4 is a sectional view of another embodiment of the present invention.

In FIG. 4 there is illustrated an alternative embodiment of the present invention which comprises a tee assembly, generally designated 50, comprising a tubular housing 52 having a lateral opening adjacent one end with a flexible sleeve 54, similar to the sleeve 16, positioned in the opening. A piston 56, either of flexible material, as shown, or of rigid construction with a flexible ring at the periphery, is slidingly positioned in the housing 52, and is connected to a piston rod 58 extending through one end of the housing and provided with a handle 60. A partition 62 is spaced from the opposite end of the housing 52 and is provided with a central aperture 64. A reed valve 66 is provided to normally cover the aperture 64 when the piston 56 is pushed to the left but is drawn away from the aperture when the piston 56 is pulled to the right to create a partial vacuum in the chamber 67 below the sleeve 54.

The tee assembly 50 operates in the same manner as the tee assembly 10 described above, but is even simpler in construction. In this respect, the ball 68 is placed on the sleeve 54 and the handle 60 is pulled back to form a partial vacuum in the chamber 66. The assembly is then placed on the ground in the position shown in FIG. 4, with the ball in position for contact by the club.

Figure 5:
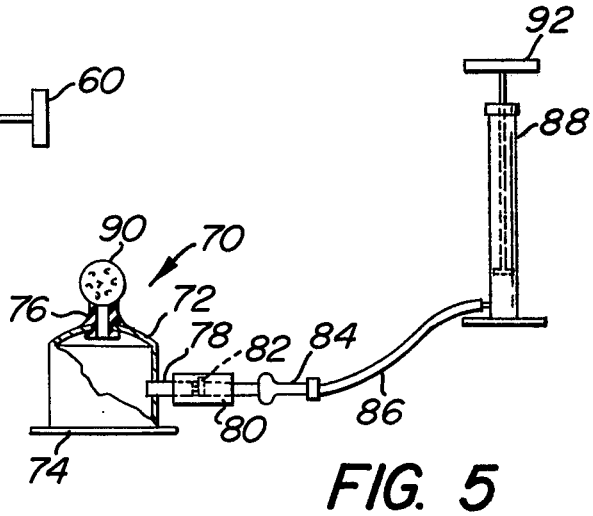
FIG. 5 is a view, partly in elevation and partly in section, of a further embodiment of the present invention.

FIG. 5 shows the further embodiment of the present invention wherein the golf tee assembly, generally designated 70, comprises a housing 72 substantially similar to the housing 10 and including a base or support pad 74 and an upper aperture in which is positioned a sleeve 76 similar to that shown at 16. However, instead of a piston and lever arm for operating such piston, there is a provided a side opening in which is arranged the inlet end of a pipe 78. Interposed in the pipe 78 is a valve housing 80 having a check valve 82 therein. The pipe is connected by a coupling 84 to a flexible hose 86. The hose 86 is connected to a bicycle pump, or the like, indicated at 88.

In operation, the housing 72 may be placed on the ground, the ball 90 placed on the sleeve 76, and the handle 92 of the pump 88 lifted to suck air out of the chamber within the housing 72 through the pipe 78 and hose 86. The check valve 82 is constructed to open during this sucking action but closes when the reverse action takes place. The ball is now in position for contact by the club.

The assembly of FIG. 5, although somewhat more complex and cumbersome than the other two forms of the invention, may be used as a permanent installation at the tee-up position if so desired. Furthermore, any other feasible type of pump or suction means may be used.

The invention claimed is:

1. A golf tee assembly comprising a hollow housing, a support for said housing, an aperture in said housing, a sleeve extending from said aperture, said sleeve having a passage therethrough in communication with said aperture, a lip surrounding said passage at that end of said sleeve which is remote from said aperture, said lip being constructed and arranged to support a golf ball upon said sleeve above said passage, a piston in said housing movable toward and away from said aperture, said piston being in sealingly slidable contact with the inner surfaces of said housing to form at least a partial vacuum in said housing behind said aperture, and a pivoted lever arm pivotally connected to said piston and said housing, said lever arm when pivoted will cause said piston to move in said housing to form said vacuum therein.

* * * * *